US007311957B2

(12) United States Patent
Bargo, II

(10) Patent No.: US 7,311,957 B2
(45) Date of Patent: Dec. 25, 2007

(54) SOUND ABSORBING MATERIAL AND PROCESS FOR MAKING

(75) Inventor: Matthew Bargo, II, Corbin, KY (US)

(73) Assignee: CTA Acoustics, Inc., Corbin, KY (US)

( * ) Notice: Subject to any disclaimer, the term of this patent is extended or adjusted under 35 U.S.C. 154(b) by 467 days.

(21) Appl. No.: 10/660,956

(22) Filed: Sep. 12, 2003

(65) Prior Publication Data

US 2004/0050619 A1 Mar. 18, 2004

Related U.S. Application Data

(60) Provisional application No. 60/410,608, filed on Sep. 13, 2002.

(51) Int. Cl.
*D04H 1/60* (2006.01)

(52) U.S. Cl. ..... 428/74; 442/161; 442/164; 442/176; 442/180; 442/416; 442/120

(58) Field of Classification Search ..... 442/161, 442/120, 164, 176, 180, 416; 428/74
See application file for complete search history.

(56) References Cited

U.S. PATENT DOCUMENTS 3,054,714 A * 9/1962 Johnston ..... 156/212
3,773,485 A * 11/1973 Corsentino et al. ..... 65/521
4,927,684 A 5/1990 Asensio et al.
4,933,125 A 6/1990 Reiniger
5,019,197 A 5/1991 Henderson
5,068,001 A * 11/1991 Haussling ..... 156/222
5,106,438 A 4/1992 Nopper et al.
5,106,679 A 4/1992 Wataya et al.
5,272,000 A * 12/1993 Chenoweth et al. ..... 442/35
5,624,518 A 4/1997 Stief et al.
6,109,389 A * 8/2000 Hiers et al. ..... 181/290
6,271,270 B1 8/2001 Muzzy et al.
6,287,678 B1 9/2001 Spengler
6,322,658 B1 11/2001 Byma et al.
6,345,688 B1 * 2/2002 Veen et al. ..... 181/290
6,387,967 B2 5/2002 Muzzy et al.
2002/0096278 A1 * 7/2002 Foster et al. ..... 162/141
2003/0134553 A1 7/2003 Sheffer

FOREIGN PATENT DOCUMENTS

CA 2459341 3/2003

* cited by examiner

*Primary Examiner*—Jenna Davis
(74) *Attorney, Agent, or Firm*—James E. Cole; Middleton Reutlinger

(57) ABSTRACT

A sound absorbing material having a homogenous mixture of an organic man-made fiber, an inorganic man-made fiber, a co-binder, and a cellulose material wherein the organic man-made fiber is polyester, the inorganic man-made fiber is fiberglass, and the co-binder is a thermo-setting resin. The cellulose material may include Kaolin clay and/or boric acid.

47 Claims, 4 Drawing Sheets

SOUND ABSORBING MATERIAL AND PROCESS FOR MAKING

CROSS-REFERENCE TO PRIOR APPLICATION

This is a utility patent application claiming priority to U.S. Provisional Patent Application No. 60/410,608, filed Sep. 13, 2002.

BACKGROUND OF THE INVENTION

The present invention relates to an improved sound absorbing material and more specifically, to a sound absorbing material comprising a blended matrix of man-made fibers, a co-binder, and fibrous cellulose or cellulose based material.

Automobile manufacturers typically use sound absorbing materials to line various compartments of an automobile, such as the engine compartment, to inhibit noise from entering a cabin or interior portion of a vehicle. The sound absorbing material may also line the interior of the vehicle, such as the headliner and floorboard, to absorb sound created from within the cabin. Automobile manufacturers require the material to meet specific standards. For instance, the sound absorbing material must withstand certain temperatures without burning or melting. To test this standard the sound absorbing material is subjected to a flame test. In the open flame test a sound absorbing material is introduced to an open flame for a specific period of time at a specific distance from the material sample. It is preferable that the sound absorbing material should not melt or burn, or if the material burns it should have a self-extinguishing characteristic.

Pure polyester is known in the art for use as a sound absorbing material and generally has good sound absorbing characteristics. However, it has been found that pure polyester does not perform well in the open flame test because the material burns and melts at high temperatures. Additionally the pure polyester generally softens and sags at temperatures above 450 degrees Fahrenheit. In an attempt to improve performance of the sound absorbing material in the flame test as well as increase the sound absorbing characteristics, some portion of fiberglass was added to the polyester sound absorbing material. Although fiberglass performed better in the flame test and had good sound absorption characteristics, it has a major drawback. Fiberglass may cause irritation to human skin, eyes and respiratory systems. Generally, the smaller the fiber sizes the harsher the irritation. Thus, although fiberglass is good in one respect it is not quite as appealing in others.

In view of the deficiencies in known materials, it is apparent that a sound absorbing material is needed having good sound absorbing qualities, having a decreased amount of fiberglass, which passes moisture absorption testing, and will pass the flame tests of automotive manufacturers.

SUMMARY OF THE INVENTION

It is an object of the present invention to provide an improved sound absorbing material which will not burn when exposed to an open flame or droop or sag when exposed to temperatures above 450 degrees Fahrenheit.

It is a further object of the present invention to provide an improved sound absorbing material which limits moisture absorption.

It is yet an even further object of the present invention to provide an improved sound absorbing material which does not require the use of a face cloth.

It is still a further object of the present invention to provide an improved sound absorbing material having fibrous cellulose blended therein.

More particularly, the improved sound absorbing material of the present invention includes a blended matrix of at least a first organic man-made fiber and preferably a first organic and a second inorganic man-made fiber. The at least first and preferably first and second man-made fiber matrix is further blended with a co-binder such as a phenolic resin, particularly phenol-formaldehyde and more particularly, a powder phenolic resin. Alternatively, other thermo-setting resins may be used as a co-binder including acrylic resin, epoxy resins, vinyl esters, urethane silicones, and other cross-linkable rubber and plastic polymers and resins and the like. These resins may be in powder, latex, oil base or solvent base form, or they may be liquid polymers.

The matrix further comprises fibrous cellulose or fibrous cellulose based material that is low density but provides increased acoustical performance and increased tensile strength. A pulp-based cellulose material is low in cost compared to other acoustical fibers. Additionally, the cellulose may be mixed with Kaolin clay to effect a fiber which does not absorb moisture. Preferably, the clay may be about 15 percent by weight of the cellulose mixture. In addition, boric acid may be added to inhibit mold and bacterial growth, as well as providing flame retardant to the matrix. This is a highly desirable characteristic since moisture absorption may lead to mildew and foul odors. However, other flame retardants may be used.

The first organic and second inorganic fibers may be polyester fibers and fiberglass fibers, respectively. The fiberglass may be selected from a plurality of types of fiberglass including rotary fiberglass, flame-attenuated fiberglass, and in a preferred embodiment textile fiberglass. However, in an alternative embodiment the matrix does not include fiberglass fibers.

The polyester may be up to 70 percent by weight, and preferably about 19 percent by weight of the finished product. The fiberglass may be up to about 50 percent by weight and preferably about 35 percent by weight of the finished product. The co-binder may be about 10 percent to about 40 percent by weight and preferably about 28 percent by weight of the finished product. Finally, the cellulose or cellulose based material may be up to about 50 percent by weight and preferably about 19 percent by weight of the finished product.

Disposed along one or both outer surfaces of the sound absorbing material may be a face cloth. One preferred face cloth may be comprised of a polyester and rayon, and more preferably about 70 percent polyester and 30 percent rayon, pure polyester, or some desirable combination thereof. The face cloth improves aesthetic appearance while providing strength to the sound absorbing material finished product. The face cloth may be applied to the sound absorbing material with a thermoset resin or a thermoplastic and may affect the amount of distortion of a polyfilm, as will be discussed hereinafter. However, the face cloth is not essential to practicing the instant invention.

The instant invention may also include at least one layer of porous polyolefin film or polyfilm affixed to the sound absorbing mat in order to absorb the lower range frequencies that the sound absorbing material may not absorb well. The polyfilm typically acts as a barrier to high frequency sounds. The porous nature of the polyfilm of the instant invention allows the polyfilm to act as an absorber for low frequency sound, yet allows a wide range of higher frequency sounds to pass through to the absorbing material wherein prior polyfilm laminates have failed. The polyfilm may be a thermo-setting plastic so that the polyfilm thermally bonds to the acoustical insulation mat. Alternatively, the polyfilm may be applied to the acoustical insulation mat with the use of resins, copolymers, polyesters and other thermoplastic materials. The polyfilm is preferably comprised of a polyolefin, particularly a polypropylene or polyethylene and should be positioned between the sound source and the acoustical insulation mat so that the film resonates against the absorbing material to destroy acoustical energy of the low frequency sound. The polyfilm preferably has a plurality of spaced acoustical flow-through openings allowing high frequency sounds to pass therethrough and be absorbed by the acoustical insulation mat. The surface area of the at least one acoustical flow-through opening may be between 0.25 percent and 50.0 percent. Prior to molding, the acoustical flow-through openings may be circular, square, or any other pre-selected geometric shape including slits. And, upon molding, the polyfilm comprises multiple random shaped apertures having various shapes, sizes, and areas permitting the film to absorb low frequency sounds and permitting high frequency sounds to pass through and be absorbed by the acoustical absorbing material. In operation the polyfilm absorbs low frequency sounds by resonating and destroying acoustical energy while reflecting some high frequency sounds. Other high frequency range sounds passing through the acoustical flow-through openings are absorbed by the acoustical insulation mat. The face cloth material may also be used with the porous polyolefin film as well.

All of the above outlined objectives are to be understood as exemplary only and many more objectives of the invention may be gleaned from the disclosure herein. Therefore, no limiting interpretation of the objectives noted is to be understood without further reading of the entire specification, claims, and drawings included herewith.

DETAILED DESCRIPTION OF THE PREFERRED EMBODIMENT

Figure 2:
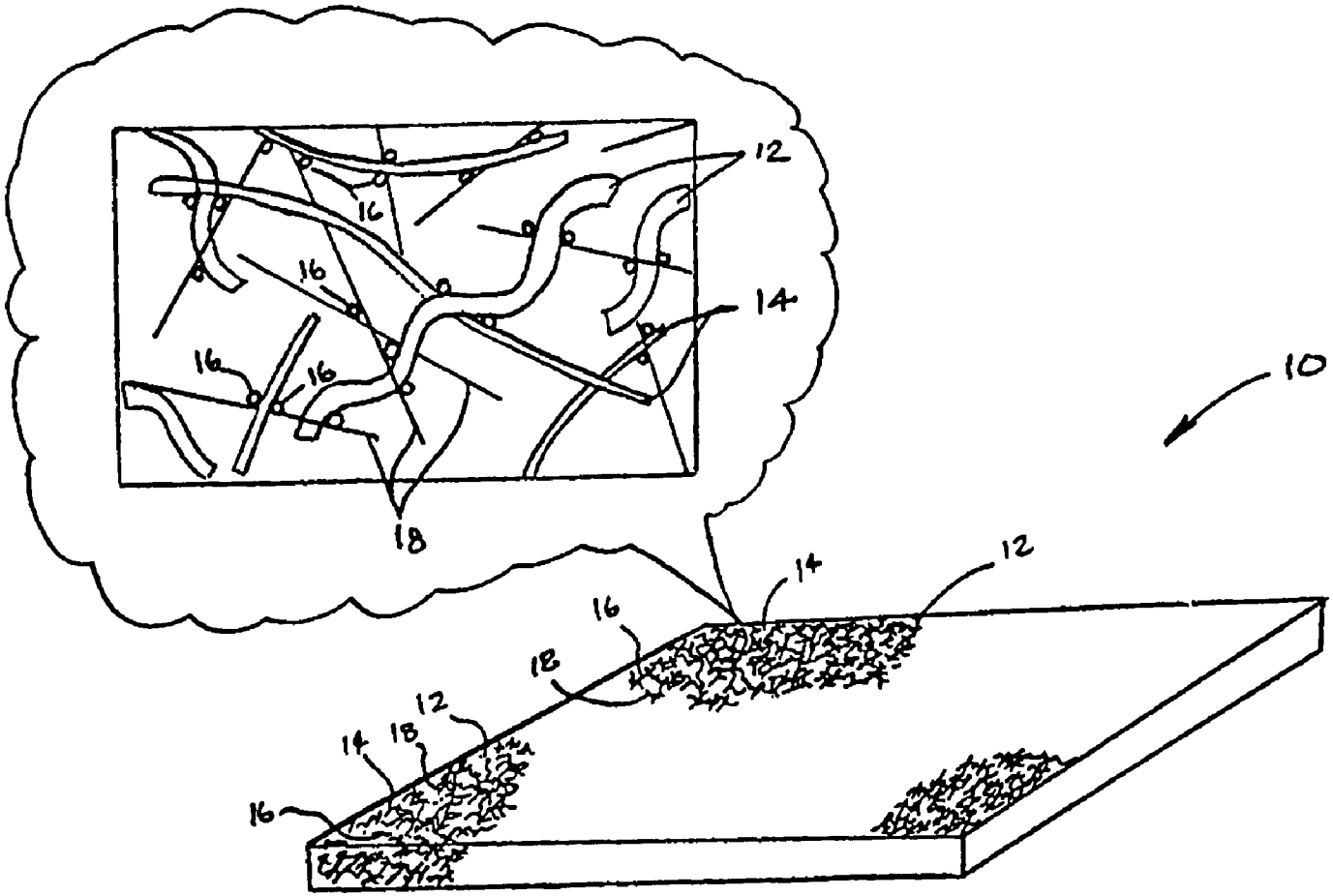
FIG. 2 shows a perspective view of a sound absorbing material of the present invention, including a magnified representation of the homogenous blended matrix of the present invention.

In accordance with the present invention, as shown in FIG. 2, a sound absorbing material 10 is provided having at least a front and a rear surface in either a molded or ductliner form. The sound absorbing material 10 has a blended homogeneous matrix of first organic fibers 12 and second inorganic fibers 14. The sound absorbing material 10 may vary in weight and thickness in order to vary the frequency absorption characteristics and may be a preselected size and shape. In one embodiment of the present invention, the sound absorbing material 10 will be from about 2 mm to about 155 mm in thickness with a preselected size and shape. The density of the sound absorbing material 10 may range from about 0.75 to about 40 pounds per cubic foot ($lbs/ft^3$).

The first organic fiber 12 of the blended matrix may be polyester. The polyester fibers 12 may generally have a length of between about 5 millimeters (mm) and about 60 millimeters (mm), and are between about 1.2 to 15 denier in diameter. Further the polyester fibers 12 may comprise up to about 70 percent by weight of the finished product and preferably about 19 percent by weight of the finished sound absorbing material or product. The polyester 12 may be virgin polyester or may be reclaimed from other industrial uses. For instance, if a lot of a polyester product is made which is not up to specification and must be discarded, this polyester product can be processed and used in the instant invention.

In accordance with the present invention a second inorganic fiber 14 may or may not be included in the blended matrix. The second inorganic fiber 14 may be a fiberglass such as rotary fiberglass, flame attenuated fiberglass, or in accordance with a present embodiment a textile fiberglass. The textile fiberglass 14 may be from about 12 mm to about 130 mm in length and greater than 5 microns in diameter. And, although it is within the scope of this invention to use flame attenuated or rotary fiberglass strands, it is preferable to use textile fiberglass, which is less irritable, more economical, and therefore preferred in a plurality of applications including, for instance the automotive industry. More particularly, the long length of the fiberglass fibers in comparison to rotary or flame attenuated fiberglass results in a sound absorbing material which may be folded without breaking, is less brittle, and is generally more durable. The textile fiberglass 14 of the present invention may comprise up to about 50 percent by weight of the finished product, preferably about 35 percent by weight of the sound absorbing material 10.

The at least polyester fibers 12, and preferably polyester fibers 12 and textile fiberglass fibers 14 of the present invention are further combined with a thermo-setting resin 16. The thermo-setting resin 16 of the instant invention includes phenolic resin, particularly phenol-formaldehyde and more particularly, a powder phenolic resin. The amount of the thermo-setting resin will be from about 10 to 40 percent, preferably about 28 percent by weight of the finished product. However other thermo-setting resins which may be used include, for example, epoxy resins, vinyl esters, urethane silicones, and others. In addition, these resins may be in powder form, latex, oil base, or solvent base form, or they may be liquid polymers.

The blended matrix further comprises fibrous cellulose 18 that is low density but provides increased acoustical performance to the sound absorbing material. Since the fibrous cellulose 18 is pulp based it is low cost compared to other fiber reinforcements. Additionally, the fibrous cellulose 18 may be mixed with Kaolin clay to inhibit moisture absorption. The Kaolin clay may be up to about 15 percent of the cellulose mixture by weight. This is a highly desirable characteristic since moisture absorption may lead to mildew and foul odors within the cabin of an automobile. Preferably, the fibrous cellulose based material 18 has an average diameter of about 0.03 millimeters and average length of about 0.08 millimeters. However, these values may vary if certain characteristics are more desirable than others. In addition, boric acid or some other appropriate compound having both anti-bacterial and anti-fungal growth properties as well as flame retarding properties may be used.

Figure 1:
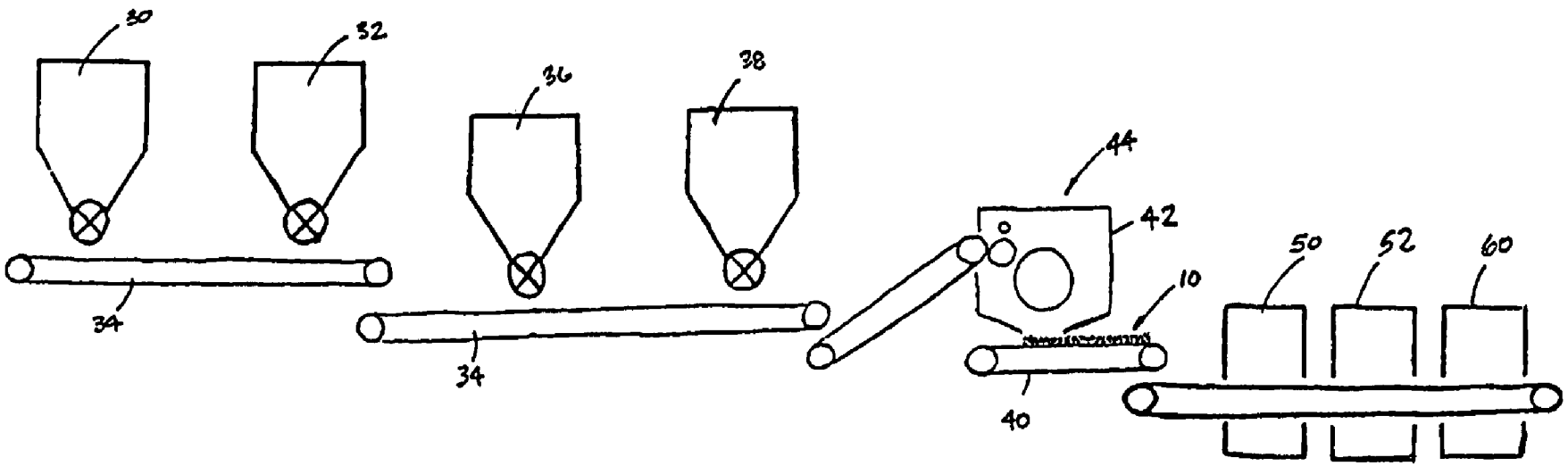
FIG. 1 shows a schematic diagram of a process manufacturing flow sheet of the insulation product of the present invention.

Referring now to FIG. 1, in the manufacture of a product of the present invention, first and second storage bins 30,32 meter out or feed the polyester 12 and textile fiberglass 14 respectively onto a first conveyor belt 34 forming an uncured mat thereon. The polyester 12 and fiberglass 14 are fed out at a rate of generally about 250 to 2000 pounds per hour from the storage bins 30,32. A mixing-picker apparatus may be used to mix and spread or separate the strands of polyester 12 and fiberglass 14. Many devices or apparatuses are known in the art for separating and spreading apart the filaments in a fiber and blending differing fibers such as polyester and fiberglass, producing an evenly distributed mix of ingredients and such a product will not be further discussed herein. However, this step is not essential at this point of the manufacturing process.

Next, third and fourth storage bins 36,38 feed out thermo-setting resin 16 and fibrous cellulose 18 onto the mat of polyester 12 and fiberglass 14. The thermo-setting resin 16 may be fed out at a rate from about 65 to about 900 pounds per hour. The cellulose may be fed at a rate of from about 10 to about 1000 pounds per hour.

Next the fiber-binder-cellulose mixture is conveyed into a mixing-picker apparatus 44 having a forming hood 42 where further mixing occurs. A mixing-picker apparatus is used to mix and spread the strands of polyester 12, fiberglass 14, thermo-setting resin 16, and cellulose 18. The high-speed rotary device facilitates uniform mixing of the sound absorbing material components. For instance, a high-speed cylindrical roller having hardened steel teeth which open the fibers and further mixes the cellulose and resin therewith may be employed. Also, various known means may be used to facilitate mixing and spreading of the first and second man-made fibers, cellulose and thermo-setting resin utilized. In the instant process, the mixing device 44 may throw the man-made fibers 12,14, the thermo-setting resin 16, and the cellulose 18 into the air. A mat forming chain conveyor or area 40 preferably has a suction or negative pressure placed thereon which generally pulls the fibers 12,14, resin 16 and cellulose 18 against the mat forming conveyor 40 forming a mat of uniform uncured fiber-binder-cellulose. Alternatively, a mat forming area may be understood include mat forming roller or other mat forming apparatus. The mat 10 is generally up to about 70 percent by weight polyester, preferably about 19 percent, up to about 50 percent by weight textile fiberglass, preferably about 35 percent, between about 10 to 40 percent co-binder, preferably about 28 percent by thermo-setting resin, and up to about 50 percent by weight cellulose based material, preferably about 19 percent. However, the present invention may also be formed as a mixture of polyester, a cellulose-based material, and a co-binder, without fiberglass.

Once the uniform uncured mat 10 is formed, the mat is conveyed to a curing oven 50. Within the curing oven 50, the uncured mat 10 is subjected to sufficient heat to at least cure and set a desired proportion of the thermo-setting resin 16. In other words the mat may be semi-cured or fully cured. In the production of cured mat or ductliner 10, the oven 50 may have an operating temperature of between about 400 and 600 degrees Fahrenheit. The temperature depends on the thickness and gram weight of the mat being produced and typically the mat remains in an oven between 1 and 4 minutes in order to produce ductliner. In the production of a semi-cured mat 10, ready for further molding, the temperature of the oven may range from 200 to 300 degrees Fahrenheit and the curing time may only be about 1 to 3 minutes so that the phenolic resin is only partially set.

Figure 3:
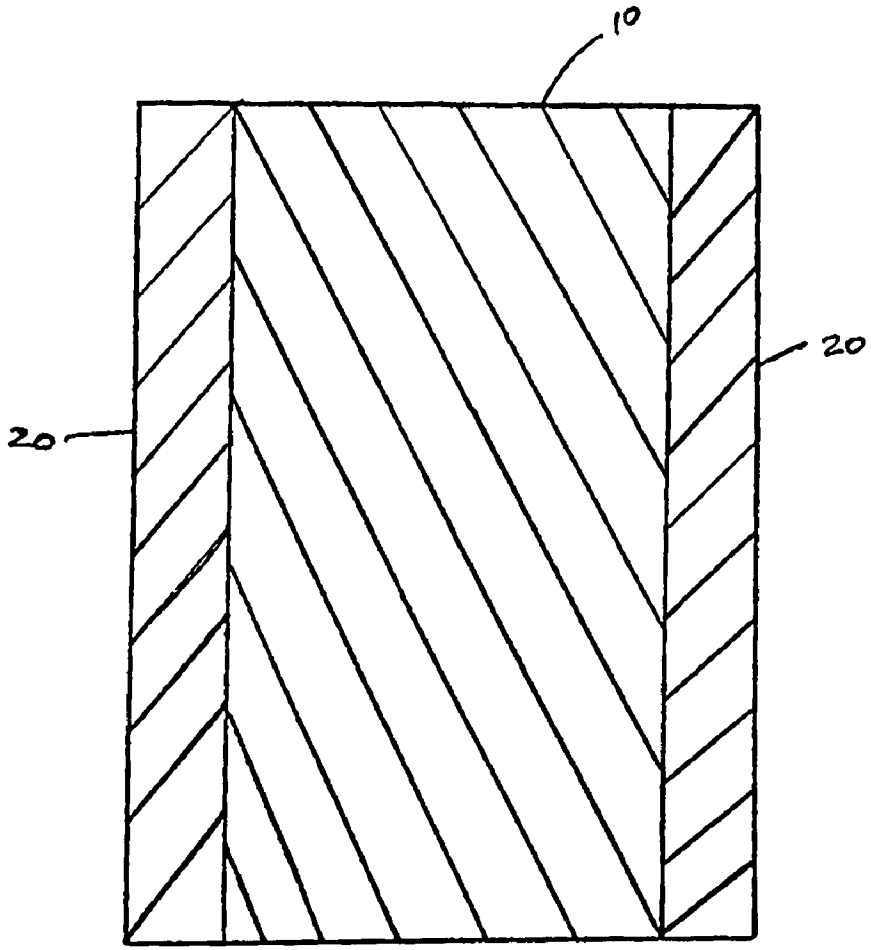
FIG. 3 shows a side sectional view of the sound absorbing material of FIG. 2 having a face cloth positioned along outer surfaces thereof; and, FIG. 4 shows a perspective view of a sound absorbing material having a polyfilm attached thereto.

Referring now to FIG. 3, in accordance with a first alternative, a face cloth 20 may be applied to one or both outer surfaces of the uncured mat or sound absorbing material 10. The face cloth 20 may be comprised of about polyester and rayon, pure polyester, or various other known combinations. A preferred face cloth 20 is about 70 percent polyester and about 30 percent rayon. The face cloth 20 improves aesthetic appearance while providing strength to the sound absorbing material finished product. The face cloth 20 may be applied to the sound absorbing material with a thermo-set resin or a thermoplastic and may affect the amount of distortion of a porous polyfilm 24, described hereinafter, which may also be applied. However, the face cloth 20 is not essential to practicing the instant invention.

Figure 4:
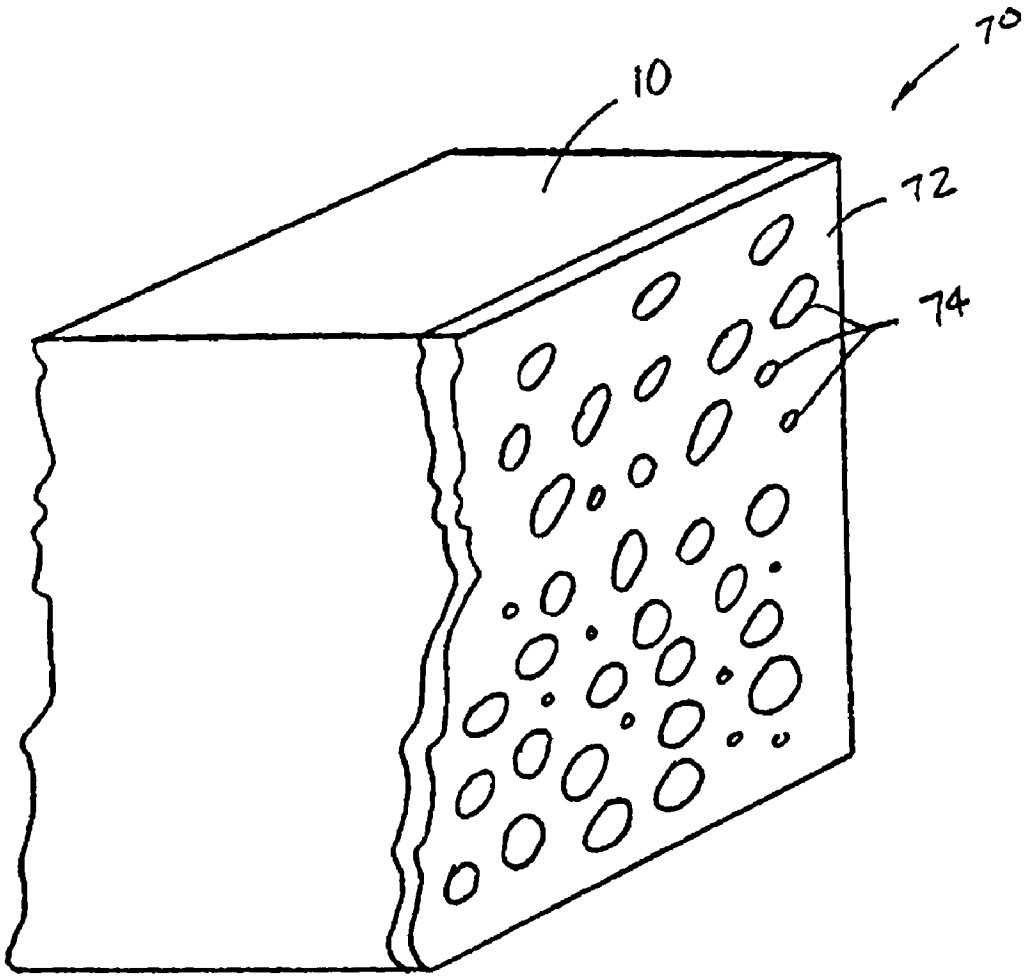

In accordance with a second alternative embodiment, a porous polyolefin film 72 may be positioned on the uncured sound absorbing material 10 forming a laminate 70, as depicted in FIG. 4. In a preferred embodiment, the polyfilm 72 is positioned between a sound source and the sound absorbing material 10. The porous polyfilm 72 has at least one acoustical flow-through opening 74, and preferably a plurality of openings 74 comprising between about 0.25 percent and 50.0 percent of the total surface area of the polyfilm 72. The plurality of acoustical flow-through openings 74 may be in a spaced configuration and the initial openings 74, prior to molding, may be a plurality of shapes for example square, circular, or slits. The polyfilm 72 may vary in thickness ranging from about 0.2 mil to about 20 mils and may also vary in weight to absorb various ranges of frequencies. The porous polyfilm 72 may be between about 0.5 and 40.0 percent by weight of the finished product.

In accordance with the second alternative embodiment of the instant invention, the porous polyfilm 72 absorbs frequencies below about 2500 Hz better than the sound absorbing material 10 alone and, when used in combination with the sound absorbing material 10, the polyfilm 72 raises the total noise reduction coefficient. The apertures 74 of the porous polyfilm 72 play an important role in absorbing a wide range of low frequencies instead of a very specific limited range. In forming the porous polyfilm 72, a plurality of spaced apertures 74 are placed in the polyolefin film 72. The apertures 74, as discussed above may be from 0.10 to 25.4 square millimeters ($mm^2$) and may be arranged in a spaced configuration. The porous polyfilm 72 is stretched over the sound absorbing material 10 with the application of heat which non-uniformly varies the density of the polyfilm 72 since the polyfilm 72 becomes thinner. In addition, stretching the polyfilm 72 over the sound absorbing material increases the area of the at least one aperture 74, which grows in stress relieving directions.

In the second alternative embodiment of the present invention, it is also desirable to use a face cloth 20. The face cloth 20 helps maintain the laminate 70 of sound absorbing material 10 and the polyfilm 72 once the laminate 70 is manufactured and molded as well as providing an aesthetically pleasing appearance.

Referring again to FIG. 1, the cured or semi-cured sound absorbing material 10 or laminate 70 leaving the curing oven may pass through a cooling chamber 50 and then through a slitter 52 where the slitter slits the finished product into sections of a pre-selected width and length. The product is then transferred by conveyor to storage for further use.

In the molding process, the sound absorbing material 10 with or without face cloth 20 or the laminate 70, will be completely cured and set into a pre-selected shape and thickness with a molding unit 60. Various types of molds may be used with the instant invention including but not limited to rotary molds, double shuttle molds, non-shuttle molds, and roll-loader molds. These molds are generally driven by hydraulic or air cylinders generating between 1 and 100 pounds per square inch (psi) of molding pressure. Typically, the molding time takes between 45 and 150 seconds with molding temperatures between about 375 degrees and 450 degrees Fahrenheit which is a function of the density and weight of the sound absorbing material 10.

The sound absorbing material 10 or molded laminate 70 may be formed in either a hot molding or a cold molding process. In a hot molding process heat may be provided to the mold cavity in a plurality of methods including hot forced air provided by gas combustion, electric heat, infrared heating, radiant heating, or heated thermal fluids. The mold temperature should be higher than the desired activation temperature to account for heat loss from the mold and the like. The activation temperature of the thermo-set resin may be between about 120 and 500 degrees Fahrenheit. Once the semi-cured sound absorbing material is positioned in the mold cavity, the mold press applies pressure.

In the cold molding process, the sound absorbing material 10 may be produced with a thermo-set resin and a thermoplastic, wherein, for instance, the thermoplastic is polyester. The uncured sound absorbing material is heated to an activation temperature of between about 120 and 500 degrees Fahrenheit. Next the laminate elements are placed in a cooled mold which lowers the temperature of the sound absorbing mat to below the activation temperature of the thermoplastic. The mold may be cooled by ambient air, by water, or by a chiller system. Within the cooled mold, pressure is applied in an amount ranging from about 1 to 100 pounds per square inch. After cold molding or hot molding the laminate 10 may be cut to any preselected size and shape. The above described hot and cold molding processes may be repeated for a sound absorbing material formed with a face cloth 20 and a polyfilm 72.

Even though only one preferred embodiment has been shown and described, it is apparent those products incorporating modifications and variations of the preferred embodiment will become obvious to those skilled in the art and therefore the described preferred embodiment should not be construed to be limited thereby.

I claim:

1. A sound absorbing material, comprising:

an organic man-made fiber;

an inorganic man-made fiber;

a thermosetting binder; and, pure cellulose fibers;

said organic man-made fiber, said inorganic man-made fiber, said binder and said cellulose material defining a homogeneous sound absorbing material.

2. The sound absorbing material of claim 1, said organic man-made fiber being polyester.

3. The sound absorbing material of claim 2, said polyester fiber being between about 5 millimeters and 60 millimeters in length.

4. The sound absorbing material of claim 2, said polyester being virgin polyester.

5. The sound absorbing material of claim 2, said polyester being reclaimed polyester.

6. The sound absorbing material of claim 2, said organic man-made fiber being up to about 70 percent by weight of said sound absorbing material.

7. The sound absorbing material of claim 6, said organic man-made fiber being about 19 percent by weight of said sound absorbing material.

8. The sound absorbing material of claim 2, said polyester being between about 1.2 and 15 denier.

9. The sound absorbing material of claim 1, said inorganic man-made fiber being fiberglass.

10. The sound absorbing material of claim 9, said fiberglass being rotary fiberglass having an average diameter of between about 4 and 8 microns.

11. The sound absorbing material of claim 9, said fiberglass being flame attenuated fiberglass having an average diameter of between about 4 and 8 microns.

12. The sound absorbing material of claim 9, said fiberglass being textile fiberglass.

13. The sound absorbing material of claim 9, said fiberglass being up to 50 percent by weight of said sound absorbing material.

14. The sound absorbing material of claim 13, said fiberglass being about 35 percent by weight of said sound absorbing material.

15. The sound absorbing material of claim 9, said fiberglass being between about 12 and 130 millimeters in length and having a diameter of between about 5 microns and 12 microns.

16. The sound absorbing material of claim 1, said binder being between about 10 percent to about 40 percent by weight of said sound absorbing material.

17. The sound absorbing material of claim 16, said binder being about 28 percent by weight of said sound absorbing material.

18. The sound absorbing material of claim 16, said binder being a thermo-setting resin.

19. The sound absorbing material of claim 18, said thermo-setting resin being a phenolic resin.

20. The sound absorbing material of claim 19, said phenolic resin being phenol formaldehyde.

21. The sound absorbing material of claim 16, said binder selected from the group consisted of epoxy resin, vinyl esters, urethane silicones, cross-linkable plastic polymers, cross-linkable rubber polymers.

22. The sound absorbing material of claim 1, said pure cellulose fiber being less than about 50 percent by weight of said sound absorbing material.

23. The sound absorbing material of claim 22, said pure cellulose fiber material being about 19 percent by weight of said sound absorbing material.

24. The sound absorbing material of claim 1, said pure cellulose fiber containing about 15 percent by weight of said Kaolin clay.

25. The sound absorbing material of claim 23, said pure cellulose fiber defined by a plurality of strands having an average diameter of about 0.03 millimeters and about 0.08 millimeters in average length.

26. The sound absorbing material of claim 1, further comprising a polyfilm layer affixed thereto.

27. The sound absorbing material of claim 26, said polyfilm layer being a porous polyolefin layer.

28. The sound absorbing material of claim 1 further comprising a preselected amount of boric acid.

29. The sound absorbing material of claim 1 further comprising a face cloth.

30. The sound absorbing material of claim 29, said face cloth formed of polyester.

31. The sound absorbing material of claim 29, said face cloth formed of about 70 percent polyester and about 30 percent rayon.

32. A sound absorbing material, comprising:

a homogeneous mixture of:

a plurality of polyester fibers;

a plurality of textile fiberglass fibers;

a thermo-setting binder;

a plurality of pure cellulose fibers; and, at least one layer of a porous polyfilm.

33. The sound absorbing material of claim 32, said porous polyfilm being a thermo-setting plastic.

34. The sound absorbing material of claim 32, said porous polyfilm being formed of polypropylene.

35. The sound absorbing material of claim 32, said porous polyfilm being formed of polyethylene.

36. The sound absorbing material of claim 32, said porous polyfilm having at least one acoustical flow-through opening sized between about 0.25 percent and 50 percent of the surface area of the polyfilm.

37. A sound absorbing material, comprising:

a homogeneous mixture including:

a plurality of polyester fibers;

a plurality of textile fiberglass fibers;

a thermo-setting binder;

a plurality of cellulose fibers; and, a preselected amount of boric acid.

38. An improved sound absorbing material, comprising:

a blended matrix of a polyester fiber and a textile fiberglass fiber;

said matrix further including a binder blended with said polyester and fiberglass fibers and pure fibrous cellulose.

39. The sound absorbing material of claim 38, said matrix being a ductliner material.

40. The sound absorbing material of claim 38, said matrix being a molded material.

41. The sound absorbing material of claim 38, said sound absorbing material having a thickness between 2 millimeters and 150 millimeters.

42. The sound absorbing material of claim 38, said polyester being reclaimed.

43. The sound absorbing material of claim 38, said fiberglass having a length of between 12 millimeters and 130 millimeters.

44. The sound absorbing material of claim 38, said fiberglass being a textile fiberglass having a diameter of about 5 microns.

45. An improved sound absorbing material, comprising:

a thermo-setting binder;

a plurality of polyester fibers;

a plurality of textile fiberglass;

a plurality of pure cellulose fibers;

said binder, said polyester fibers, said textile fiberglass and said pure cellulose fibers homogeneously mixed and molded to provide said sound absorbing material which inhibits sagging at temperatures above 450 degrees Fahrenheit, inhibits burning when exposed to an open flame, and inhibits moisture absorption.

46. A sound absorbing material, comprising:

an in-organic man-made fiber;

an organic man-made fiber;

a binder; and, pure cellulose fibers;

said organic man-made fiber, said in-organic made fiber, said pure cellulose fibers and said binder homogeneously mixed and defining said sound absorbing material which inhibits sagging at temperatures above 450 degrees Fahrenheit, inhibits burning when exposed to an open flame, and inhibits moisture absorption.

47. The sound absorbing material of claim 16, said co-binder selected from the group consisting of powder, latex, oil base, solvent base, and liquid polymer.

* * * * *